United States Patent [19]

Settineri et al.

[11] 3,996,147

[45] Dec. 7, 1976

[54] NOVEL SULFONIUM CORROSION INHIBITORS IN AQUEOUS ACID SOLUTIONS

[75] Inventors: William J. Settineri; Wayne W. Frenier, both of Midland; James H. Oswald, Bay City, all of Mich.

[73] Assignee: The Dow Chemical Company, Midland, Mich.

[22] Filed: Aug. 8, 1973

[21] Appl. No.: 386,652

Related U.S. Application Data

[63] Continuation-in-part of Ser. No. 118,174, Feb. 23, 1971, abandoned.

[52] U.S. Cl. ..... 252/149; 252/146; 252/147; 252/394; 252/395

[51] Int. Cl.[2] ..... C11D 7/00

[58] Field of Search ..... 252/147, 87, 149, 394, 252/395, 391, 146; 260/607 B; 21/2.7 R

[56] References Cited

UNITED STATES PATENTS

| | | | |
|---|---|---|---|
| 2,078,256 | 4/1937 | Leiber et al. | 252/77 X |
| 2,396,938 | 3/1946 | Bersworth | 252/142 X |
| 3,060,156 | 10/1962 | Rassweiler et a. | 260/79 |
| 3,419,501 | 12/1968 | Levy | 252/137 |
| 3,668,137 | 6/1972 | Gardner | 252/151 X |

*Primary Examiner*—Mayer Weinblatt
*Assistant Examiner*—Edith R. Buffalow
*Attorney, Agent, or Firm*—L. Wayne White

[57] ABSTRACT

The corrosion of metal surfaces in contact with aqueous acid cleaning solutions is inhibited by sulfonium salt corresponding to the formula

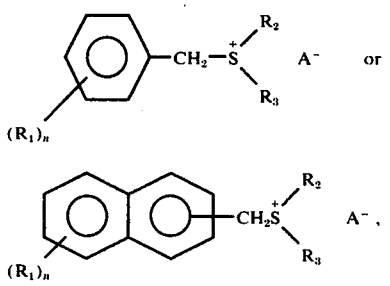

wherein $n$ is 1 or 2; $R_1$ is an electron withdrawing group; $R_2$ is a hydrocarbyl radical or inertly-substituted hydrocarbyl radical of up to about 24 carbon atoms; $R_3$ is alkyl of from 1 to 4 carbon atoms, inertly-substituted alkyl of 2–4 carbon atoms, allyl, phenyl or inertly-substituted phenyl; or $R_2$ and $R_3$ are joined to form a 5- or 6-membered heterocyclic ring; and $A^-$ is a compatible anion. These sulfonium salts are effective corrosion inhibitors even in the presence of ferric ions.

16 Claims, No Drawings

NOVEL SULFONIUM CORROSION INHIBITORS IN AQUEOUS ACID SOLUTIONS

CROSS-REFERENCE TO RELATED APPLICATION:

This is a continuation-in-part of U.S. patent application Ser. No. 118,174 filed Feb. 23, 1971 now abandoned, entitled "Nitrobenzyldialkylsulfonium Compound as Corrosion Inhibitor in Aqueous Acid Solutions."

BACKGROUND OF THE INVENTION

Iron oxide encrustations, commonly known as rust or iron oxide scale, frequently form on ferrous metal surfaces. Such surface deposits are objectionable on ferrous articles which are scheduled to be refinished (e.g. sheet steel) and are particularly troublesome when located on the surfaces of tubing and other conduits (e.g., boiling tubing, heat exchangers, connecting piping, and the like) wherein the deposits can restrict flow and interfere with heat exchange.

Various methods of removing such surface deposits have been devised, a common one being to contact the ferrous surface with an aqueous acidic cleaning solution (e.g. aqueous HCl) and thereby dissolve and remove the iron oxide encrustations from the surface. An iron salt typically results from this operation, the specific salt depending upon the acidic cleaning medium used. E.g., $FeCl_3$ and/or $FeCl_2$ are formed when HCl is used.

Such iron salts are generally soluble to at least a limited extent in the cleaning media. Ferric ions thus result.

Corrosion of ferrous metal surfaces in contact with aqueous acids is known. It is also known that the presence of ferric ion causes severe corrosion problems of ferrous metal surfaces during the above mentioned acid cleaning process. Namely, the cleaning solution attacks (corrodes) the freshly cleaned metal surface with the attendant loss of metal. In the presence of oxygen, ferric ions are continually regenerated accentuating the problem.

Many compounds have been included as corrosion inhibitors in such cleaning solutions but their effectiveness in the presence of ferric ion is generally non-existent or quite low.

Similarly, the corrosion of other common construction metals (and metal alloys) in contact with aqueous acid solution is a definite problem. E.g., in the above-mentioned process of cleaning ferrous metal surfaces with acid solutions, other metals may be present as an integral part of the system being cleaned (e.g. copper, copper alloys, aluminum, zinc, zinc alloys, stainless steels, etc.), which may be similarly corroded.

It is therefore an object of this invention to inhibit the acid induced corrosion of metal surfaces, particularly ferrous and cuprous metal surfaces, in contact with aqueous acid solutions.

Another object of this invention is to inhibit acid induced corrosion of ferrous metal surfaces even in the presence of ferric ions.

In the parent application Ser. No. 118,174, these objects were achieved by using p-nitrobenzyldialkylsulfonium salts. Subsequent investigation has shown that other sulfonium salts (as hereafter described) are also useful corrosion inhibitors.

SUMMARY OF THE INVENTION

It has now been discovered that the sulfonium salts represented by I below are highly effective in inhibiting the corrosion of metals, particularly ferrous and cuprous metals, in contact with aqueous acid solutions.

The sulfonium salts correspond to the formula

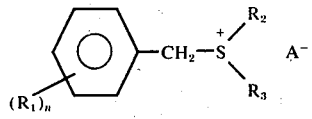

or I

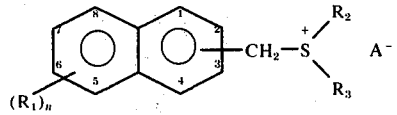

II wherein $n$ is 1 to 2 (preferably 1); $R_1$ is an electron withdrawing substituent; $R_2$ is a hydrocarbyl radical or an inertly-substituted hydrocarbyl radical of up to 24 carbon atoms with the proviso that $R_2$ has at least 6 carbon atoms when said sulfonium salt corresponds to Formula I and $R_1$ is any substituent other than p-nitro; $R_3$ is an alkyl radical of from 1 to 4 carbon atoms, an inertly-substituted alkyl of from 2 to 4 carbon atoms, allyl, phenyl or an inertly-substituted phenyl radical; or $R_2$ and $R_3$ are joined to form a 5- or 6-membered heterocyclic ring with the sulfonium atom being the sole hetero atom; $A^-$ is a compatible anion which can be varied to convenience. $R_2$ is preferably alkyl of 1 to about 18 carbons and $R_3$ is preferably alkyl of 1 to 4 carbons (most preferably methyl or ethyl).

The instant sulfonium salts are effective at low concentrations (e.g. 2 to 4 millimoles/liter) and are, surprisingly, effective even in the presence of ferric ions. Thus, the above-described ferric ion corrosion problem experienced during the cleaning of ferrous metal surfaces can be substantially reduced if not eliminated by incorporating into the aqueous acidic cleaning solution a small but sufficient amount of I and/or II to produce the desired inhibition effect.

DETAILED DESCRIPTION OF THE INVENTION

The sulfonium salts represented by I and II above are a class of compounds conventionally prepared by reacting a benzyl halide with a thio ether, as illustrated by the following equation:

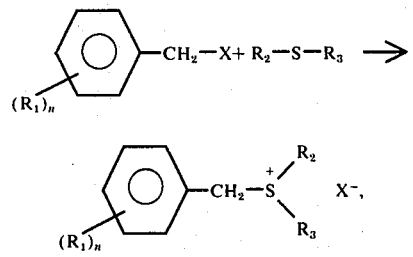

wherein X is halo (normally chloro), $n$ is 1 or 2 and $R_1$–$R_3$ have the aforesaid meaning. Conventional ion-exchange procedures can be used to exchange the anion of the sulfonium salt. The compounds of Formula II are prepared in an analogous procedure.

The term "electron withdrawing group" as used in the description of R in I and II is meant in the conventional sense. The electronic inductive effect of ring substituents on aromatic compounds is widely known in organic chemistry and is a concept taught in most elementary organic chemistry texts. Accordingly, a complete listing of electron withdrawing groups will not be here presented. Any electron withdrawing group can be used as a ring-substituent on the sulfonium salts provided said group in inert towards the sulfonium moiety and is stable in the aqueous acid cleaning solutions.

Examples of suitable such electron withdrawing groups include halo (i.e., fluoro, chloro, bromo and iodo), cyano (—CN), nitro, carboxyl (—C(O)OH), keto (—C(O)—R), sulfo (—$SO_3H$), sulfone (—S(O)(O)R), haloalkyl having at least 2 halo atoms attached to the α-carbon atom adjacent to the aromatic ring (e.g., —$CF_3$, —$CCl_3$, —$CBr_3$, etc.) and the like. Sulfonium salts bearing halo, cyano, nitro, carboxyl, sulfo, trifluoromethyl or trichloromethyl group(s) are the most common and are therefore preferred.

Examples of suitable such salts include those corresponding to I and having the values assigned in Table A.

Table A

| No. | $R_1$ | $R_2$ | $R_3$ | $A^-$ |
|---|---|---|---|---|
| 1 | p-I | $C_8H_{17}$ | $C_2H_4OH$ | Cl |
| 2 | o-C(O)$CH_3$ | $C_8H_{37}$ | $CH_3$ | $HSO_4$ |
| 3 | m-C(O)$C_6H_5$ | $C_6H_{13}$ | $CH_2CH{=}CH_2$ | Br |
| 4 | m-$SO_3H$ | $C_{24}H_{49}$ | $CH_3$ | I |
| 5 | p-Cl | $CH_2{-}C_6H_4{-}C_4H_9$ | $CH_3$ | Tosylate |
| 6 | p-$CCl_3$ | Cyclohexyl | $CH_2CH_2CN$ | Acetate |
| 7 | p-COOH | $-C_6H_4-C_{12}H_{25}$ | $CH_3$ | $H_2PO_4$ |
| 8 | m-$SO_3H$ | $C_{10}H_{20}$ | $C_4H_8OH$ | $NO_3$ |
| 9 | p-S(O)(O)$CH_3$ | $C_{12}H_{25}$ | $C_6H_5$ | Br |
| 10 | p-$NO_2$ | $CH_2CH{=}CH_2$ | $C_6H_4Cl$ | Cl |
| 11 | o-$NO_2$ | $C_6H_{13}$ | $C_2H_5$ | Cl |

In the above Table, $n$ is 1. Other salts within I wherein $n$ is 2 can obviously be used, e.g., 3,4-dicarboxybenzyl octyl methyl sulfonium chloride, 2,4-dichlorobenzyl dodecyl 2-hydroxyethyl sulfonium bisulfate, etc.

Other examples of suitable sulfonium salts include the following:

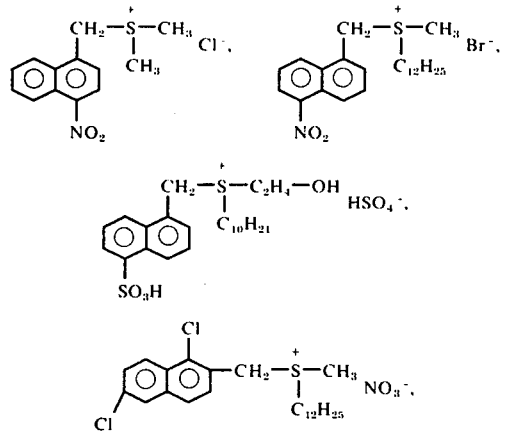

and the like. Either or both aromatic rings in II may bear the electron withdrawing substituent(s).

The p-nitrobenzyldialkyl (1–4 carbons) sulfonium salts are a particularly preferred class of sulfonium inhibitors.

The concentration of sulfonium salt used in the acid solutions may vary depending upon the particular salt, the particular metal and the degree of corrosion inhibition desired. Typically, concentrations of from about $1 \times 10^{-6}$ to about 0.1 moles of sulfonium salt per liter of solution are sufficient and concentrations of from about $1 \times 10^{-4}$ to 0.01 moles/liter are generally preferred.

The acid solutions suitable for use herein are aqueous solutions of nonoxidizing inorganic acids, such as HF, HCl, $H_2SO_4$, $H_3PO_4$, etc., and mixtures thereof (oxidizing inorganic acids include $HNO_3$, $HClO_4$, $CrO_3$, etc.); or aqueous solutions of organic acids, such as formic acid acetic acid, sulfamic acid, hydroxy acetic, citric acid, etc., and mixtures thereof; or are aqueous solutions of known chelating agents, such as ethylenediaminetetraacetic acid, hereafter EDTA (and the ammonium, amine, or alkali metal salts of EDTA), and other like polyaminepolycarboxylic acids and the like; and mixtures of such aqueous acid solutions. The most common cleaning solutions are aqueous solutions of HCl and aqueous solutions of EDTA and amine or alkali metal salts of EDTA. The acid solutions may be buffered to maintain a desired pH level with conventional buffering agents, such as citric acid, acetic acid, and salts thereof. The pH values of acid cleaning solutions typically range from 1 to 5 for aqueous solutions of organic acids, and from pH 2–5 for chelating agents, such as the EDTA type cleaning solutions. The normality of cleaning solutions using inorganic acids is typically greater than 1.

The following examples further illustrate the invention.

GENERAL PROCEDURE

Coupons of carbon steel (having 98.7% Fe, 0.3% Mn; and 0.05% C) having approximately 40 square centimeters of surface area were (a) scrubbed thoroughly with a soap-filled pad of steel wool in warm water, (b) rinsed with water, (c) washed with acetone, (d) pickled for 5 minutes in 10% aqueous HCl, (e) dried in air, and (f) weighed. The coupons thus prepared were then suspended from glass hooks in a stirred acid cleaning solution at 25° C. or 50° C. for normally 16 hours; the coupons being completely immersed in the solution. The coupons were then removed from the acid solutions, washed with soap and warm water, rinsed, dried and weighed. The weight loss resulting from such treatment is a measure of corrosion. The weight loss rate (WLR), having the units lbs./ft.$^2$/day is determined as follows:

$$\text{WLR} = \frac{(49.15)\ (\text{weight loss in gm.})}{(\text{original weight in gm.})\ (\text{SF})\ (\text{time})},$$

wherein (a) 49.15 is a conversion factor for converting gm./cm.$^2$/hr. to lbs./ft.$^2$/day; (b) SF = strip factor = average ratio of surface area (cm.$^2$) to weight (gm.); and (c) the time is measured in hours. The quantity of acid cleaning solution in each case was approximately 1400 milliliters.

The effectiveness of the sulfonium salts was determined by comparing the WLR of a cleaning solution containing the sulfonium salts (WLR (test)) against the WLR of an identical cleaning solution without the sulfonium salts (WLR (blank)). The comparative data is reported as the "Percent Protection" which is calculated as follows:

$$\text{Percent Protection} = \frac{\text{WLR (blank)} - \text{WLR (test)}}{\text{WLR (blank)}} \times 100.$$

The sulfonium salts were evaluated in three representative acid cleaning solutions. Solution "A" was a 3.8 percent by weight, total weight basis, aqueous solution of an ammonium salt of ethylenediaminetetracetic acid buffered at a pH of 5 with citric acid and contained 0.10 percent by weight, total weight basis, of $Fe^{+3}$ (added as $FeNH_4(SO_4)_2 \cdot 12H_2O$). Solution "B" was a 10 percent by weight, total weight basis, aqueous solution of HCl, and 0.10 percent by weight of $Fe^{+3}$ (added as $FeCl_3$). Solution "C" was a 10 percent by weight, total weight basis, aqueous solution of $H_2SO_4$ and 0.1 percent by weight of $Fe^{+3}$ (added as $FeNH_4(SO_4)_2 \cdot 12H_2O$).

EXAMPLE 1 p-Nitrobenzyldimethylsulfonium nitrate was added as the inhibitor to an aqueous acid solution at a concentration of $4 \times 10^{-4}$ moles/liter. Said acid solution consisting of 3.8 percent by weight of the ammonium salt(s) of ethylenediaminetetracetic acid and 0.1 percent by weight, total weight basis in each instance, of $Fe^{+3}$ (added as $FeNH_4(SO_4)_2 \cdot 12H_2O$. The acid solution was buffered with citric acid at a pH of 5. The coupons prepared above were immersed in this solution (suspended from glass hooks) and maintained therein for a period of 16 hours with stirring and at 25° C. After the test, the coupons were scrubbed with soap and water, rinsed, dried and weighed. The WLR (test) was determined to be 0.004 lbs./ft.$^2$/day. The percent protection was 89%.

EXAMPLES 2–14

Using substantially the same procedure set forth in Example 1, the following sulfonium salts were evaluated as inhibitors at the same inhibitor level as Example 1 and in the acidic solutions specified in Table B.

Table B

| Ex. | Inhibitor | Percent Protection EDTA/$Fe^{+3}$ | Percent Protection HCl/$Fe^{+3}$ |
|---|---|---|---|
| 2 | p-Nitrobenzyldimethylsulfonium chloride | 91 | |
| 3 | p-Nitrobenzyldodecylmethylsulfonium chloride | 96 | 59 |
| 4 | m-Nitrobenzyldodecylmethylsulfonium chloride | 47 | 62 |
| 5 | o-Nitrobenzyldodecylmethylsulfonium chloride | 97 | 62 |
| 6 | p-Fluorobenzyldodecylmethylsulfonium chloride | 60 | 64 |
| 7 | m-Fluorobenzyldodecylmethylsulfonium chloride | 92 | 57 |
| 8 | o-Fluorobenzyldodecylmethylsulfonium chloride | 82 | 59 |
| 9 | p-Chlorobenzyldodecylmethylsulfonium chloride | 57 | 57 |
| 10 | p-Bromobenzyldodecylmethylsulfonium chloride | 94 | 79 |
| 11 | m-Trifluoromethyldodecylmethylsulfonium chloride | 93 | 86 |
| 12 | p-Carboxybenzyldodecylmethylsulfonium chloride | 58 | 64 |
| 13 | p-Cyanobenzyldodecylmethylsulfonium chloride | 94 | 59 |
| 14 | Benzyldodecylmethylsulfonium chloride | 3 | 48 |

The acid solution designated in Table B as EDTA/-$Fe^{+3}$ was the same acid solution as used in Example 1. The acid solution designated HCl/$Fe^{+3}$ was a 10 percent HCl solution containing 0.1 percent $Fe^{+3}$ added as either $FeCl_3$ or $FeNH_4(SO_4)_2 \cdot 12H_2O$.

EXAMPLES 15–20

The sulfonium salts used in Examples 4, 7, 10, 11, 13 and 14 were evaluated using essentially the same procedure as per Example 1 except no ferric salt was added. The sulfonium salts from Examples 4, 7, 10, 11, 13 and 14 gave 88–92 percent protection whereas the unsubstituted benzylsulfonium salt from Example 14 gave only 74 percent protection.

Other sulfonium salts within Formula I can be similarly used.

We claim:

1. An aqueous acidic cleaning solution of at least one nonoxidizing inorganic acid or organic acid or mixtures thereof having dissolved or dispersed therein at least one sulfonium salt corresponding to the formula

I

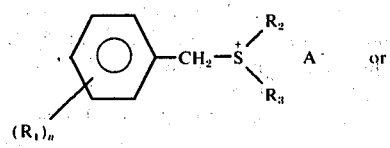

II

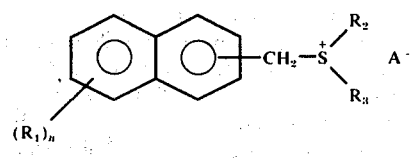

wherein $n$ is 1 or 2; $R_1$ is an electron withdrawing substituent is inert towards the sulfonium moiety and is stable in the aqueous acid cleaning solutions; $R_2$ is a hydrocarbyl radical of from 1 to about 24 carbon atoms with the provision that $R_2$ has at least 6 carbon atoms when said sulfonium salt corresponds to I and $R_1$ is any substituent other than p-nitro; $R_3$ is an alkyl radical of from 1 to 4 carbon atoms, an inertly-substituted alkyl of 2 to 4 carbon atoms, phenyl or inertly-substituted phenyl; or $R_2$ and $R_3$ are joined to form a 5- or 6-membered heterocyclic ring with the sulfonium atom being the sole hetero atom; $A^-$ is a compatible anion; said sulfonium salt being present in an amount at least sufficient to inhibit the acid-induced corrosion of ferrous metals in contact with said solution and ferric ions.

2. The composition defined by claim 1 wherein $R_3$ is methyl or ethyl.

3. The composition defined by claim 1 wherein $R_2$ is alkyl.

4. The composition defined by claim 1 wherein said sulfonium salt corresponds to formula I.

5. The composition defined by claim 1 wherein said sulfonium salt corresponds to formula II.

6. The composition defined by claim 1 wherein n is 1 and $R_1$ is halo, cyano, nitro, carboxyl, sulfo, trifluoromethyl or trichloromethyl.

7. The composition defined by claim 1 wherein said sulfonium salt is a p-nitrobenzyldialkyl sulfonium salt, each alkyl group in said sulfonium salt being of from 1 to 4 carbon atoms.

8. The composition defined by claim 1 wherein said acid is an aqueous solution of a nonoxidizing inorganic acid or a mixture of such acids.

9. The composition defined by claim 8 wherein said inorganic acid is HCl, $H_2SO_4$ or $H_3PO_4$.

10. The composition defined by claim 9 wherein said inorganic acid is HCl.

11. The composition defined by claim 1 wherein said acid is an aqueous solution of an organic carboxylic or polycarboxylic acid or mixtures thereof.

12. The composition defined by claim 11 wherein said acid is an aqueous solution of a polyaminepolycarboxylic acid or an ammonium-, amine- or alkali metal salt thereof, or mixtures thereof.

13. The composition defined by claim 12 wherein said acid is ethylenediaminetetraacetic acid or the ammonium-, amine- or alkali metal salt thereof.

14. The composition defined by claim 6 wherein said acid is ethylenediaminetetraacetic acid or the ammonium-, amine- or alkali metal salt thereof, and wherein $R_2$ is alkyl and $R_3$ is methyl or ethyl.

15. In the process of treating ferrous metal surfaces to remove iron oxide encrustations by treating said metal surface with an aqueous acid cleaning solution, the improvement consisting of using the composition defined by claim 1 as said cleaning solution.

16. A process of inhibiting the acid-induced and ferric ion-induced corrosion of metal surfaces in contact with an aqueous acid cleaning solution, said process comprising incorporating in said acid solution a sulfonium salt corresponding to the formula

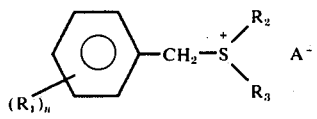

or I

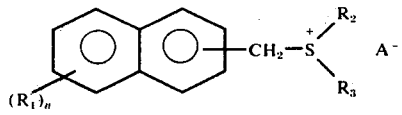

II wherein $n$ is 1 or 2; $R_1$ is an electron withdrawing substituent is inert towards the sulfonium moiety and is stable in the aqueous acid cleaning solutions; $R_2$ is a hydrocarbyl radical of from 1 to about 24 carbon atoms with the provision that $R_2$ has at least 6 carbon atoms when said sulfonium salt corresponds to I and $R_1$ is any substituent other than p-nitro; $R_3$ is an alkyl radical of from 1 to 4 carbon atoms, an inertly-substituted alkyl of 2 to 4 carbon atoms, phenyl or inertly-substituted phenyl; or $R_2$ and $R_3$ are joined to form a 5- or 6-membered heterocyclic ring with the sulfonium atom being the sole hetero atom; $A^-$ is a compatible anion; said sulfonium salt being present in an amount at least sufficient to inhibit the acid-induced corrosion of ferrous metals in contact with said solution and ferric ions.

* * * * *